US006978625B1

(12) United States Patent
Kim

(10) Patent No.: US 6,978,625 B1
(45) Date of Patent: Dec. 27, 2005

(54) SYSTEM FOR FORMING AEROSOLS AND COOLING DEVICE INCORPORATED THEREIN

(75) Inventor: Se-Ho Kim, Kyonggi-do (KR)

(73) Assignee: K.C. Tech Co., Ltd., (KR)

( * ) Notice: Subject to any disclaimer, the term of this patent is extended or adjusted under 35 U.S.C. 154(b) by 294 days.

(21) Appl. No.: 10/380,851

(22) PCT Filed: Sep. 19, 2001

(86) PCT No.: PCT/KR01/01575

§ 371 (c)(1),
(2), (4) Date: Mar. 17, 2003

(87) PCT Pub. No.: WO02/24316

PCT Pub. Date: Mar. 28, 2002

(30) Foreign Application Priority Data

Sep. 19, 2000 (KR) ..... 2000/0054910

(51) Int. Cl.[7] ..... F17C 7/02
(52) U.S. Cl. ..... 62/52.1; 62/303; 134/94.1
(58) Field of Search ..... 62/52.1, 303, 49.1, 62/64; 134/102.1, 198, 94.1; 165/95

(56) References Cited

U.S. PATENT DOCUMENTS 4,631,250 A 12/1986 Hayashi
4,981,171 A * 1/1991 Tippmann ..... 165/125
5,209,028 A 5/1993 McDermott et al.
5,226,260 A * 7/1993 Mar et al. ..... 451/39
5,294,261 A 3/1994 McDermott et al.
5,395,454 A * 3/1995 Robert ..... 134/6
5,545,073 A * 8/1996 Kneisel et al. ..... 451/39
5,558,110 A * 9/1996 Williford, Jr. ..... 134/56 R
5,651,834 A * 7/1997 Jon et al. ..... 134/31

(Continued)

FOREIGN PATENT DOCUMENTS

EP 0 332 356 9/1989

(Continued)

OTHER PUBLICATIONS

International Search Report—PCT/KR01/01575; ISA/Austrian Patent Office; Dec. 27, 2001.

*Primary Examiner*—William Doerrler
*Assistant Examiner*—Mohammad M. Ali
(74) *Attorney, Agent, or Firm*—Harness, Dickey & Pierce, P.L.C.

(57) ABSTRACT

The present invention relates to a cooling device (30) of the reverse Carnot cycle-type using a refrigerant, and an areosol generation system including it. The cooling device (30) includes a refrigerator (310, 320) of the reverse Carnot cycle-type, a cleaning medium conduit (120), a temperature sensor (130), and a heater (140). The intermediate portion of the cleaning medium conduit and the evaporator are wound like a coil in the same configuration so as to maximize the contacting area therebetween. The temperature sensor (130) measures the temperature of the carbon dioxide discharged from the cooling device (30), and the heater (140) is arranged to contact the evaporator of the refrigerator and the intermediate portion of the cleaning medium conduit so as to precisely adjust the liquefying rate of the carbon dioxide according to the temperature measured by the temperature sensor. The carbon dioxide is refrigerated at a temperature in the range of −80° C. to −100° C. through the cooling device (30), transformed into liquid phase.

8 Claims, 5 Drawing Sheets

U.S. PATENT DOCUMENTS 5,679,062 A * 10/1997 Goenka ..... 451/75
5,853,128 A * 12/1998 Bowen et al. ..... 239/329
5,860,285 A * 1/1999 Tulpule ..... 62/127
5,908,510 A * 6/1999 McCullough et al. ..... 134/2
5,925,024 A * 7/1999 Joffe ..... 604/313
6,449,873 B1 * 9/2002 Yoon et al. ..... 34/448
6,658,880 B1 * 12/2003 Bruzzo ..... 62/238.3

FOREIGN PATENT DOCUMENTS

EP 0 633 098 1/1995
JP 405312351 A * 11/1993
JP 02000146486 A * 5/2000

* cited by examiner

SYSTEM FOR FORMING AEROSOLS AND COOLING DEVICE INCORPORATED THEREIN

TECHNICAL FIELD OF THE INVENTION

The present invention relates to a system for generating an aerosol and a cooling device incorporated therein, and more particularly to a $CO_2$ aerosol generation system for providing a jet of a $CO_2$ aerosol consisting of solid fine particles of frozen $CO_2$.

BACKGROUND OF THE ART

Physical or chemical contamination is very detrimental to miniaturized electronic devices such as LCD, conductive thin film, and integrated circuit. As the size of such a microelectronic device is more compactly reduced, the contamination due to dust is a great factor adversely contributing to the yield rate and defective proportion of production. This augments the necessity of cleaning microelectronic devices.

In order to resolve such problems, there have been proposed various methods of cleaning microelectronic surfaces.

U.S. Pat. No. 5,294,261 discloses a system for cleaning microelectronic surfaces using an Ar or $N_2$ aerosol as a cleaning medium. This system provides a process for cleaning microelectronic surfaces comprising the steps of refrigerating highly pure and highly pressurized argon and nitrogen to a temperature in the range of −160° C. to −200° C. so as to form a cryogenic substance, expanding the cryogenic substance at a low pressure by passing through a nozzle or valve to thereby generate an aerosol consisting of fine solid particles, and making the aerosol impinge upon the microelectronic surfaces. In this case, the argon and nitrogen as cleaning mediums should be cooled down to a very low temperature, which are hardly maintained at solid phase in the atmosphere because of high temperature difference, and therefore the cleaning process must be performed mostly in a vacuum.

Another U.S. Pat. No. 5,486,132 discloses a system for cleaning microelectronic surfaces using a $CO_2$ aerosol as a cleaning medium. In this case, the carbon dioxide as the cleaning medium is refrigerated by a cooling device to a relatively higher temperature in the range of −80° C. to −100° C.

The cooling device used in the above-mentioned systems include a heat exchanger containing liquefied nitrogen as the refrigerant with a temperature of −198° C. or less, through which the cleaning medium is refrigerated. Such cooling device employing the liquefied nitrogen suffers a drawback that the cleaning medium may be over-refrigerated because of difficulties in temperature control. If the cleaning medium is over-refrigerated, it may be solidified before being expanded after passing through the heat exchanger and block the passageway of the conduit and the nozzle. In order to prevent such event increased is the pressure of the cleaning medium, but it increases consumption of the cleaning medium. Moreover, the cooling device requires liquefied nitrogen to be continuously supplied to the heat exchanger, resulting in consumption of a great amount of liquefied nitrogen.

TECHNICAL SOLUTION OF THE INVENTION

In order to resolve the above mentioned problems is employed a cooling device of the reverse Carnot cycle-type using a single or mixed gas refrigerant, wherein the refrigerant is cycled through the processes of adiabatic compression by the compressor, condensation by the condenser, adiabatic expansion by the expansion valve, and evaporation by the evaporator. In this case, the cleaning medium is refrigerated by being deprived of heat by the refrigerant in the evaporator.

It is an object of the present invention to provide a cooling device of the reverse Carnot cycle-type using a refrigerant, and an aerosol generation system including it.

It is another object of the present invention to provide a cooling device of the reverse Carnot cycle-type using two different refrigerants for two-stage cooling, and an aerosol generation system including it.

According to one aspect of the present invention, a cooling device comprises an evaporator wound like a coil for flowing a refrigerant made to have low temperature and low pressure through a compressor, condenser and expansion valve; a cleaning medium conduit, for flowing a cleaning medium, consisting of an inlet and outlet and an intermediate portion wound like a coil along the evaporator; a temperature sensor arranged in the outlet of the cleaning medium conduit for measuring the temperature of the cleaning medium discharged; and a heater controlled according to the temperature measured by the temperature sensor.

According to another aspect of the present invention, a cooling device comprises a first evaporator wound like a coil for flowing a first refrigerant passed through a first compressor, first condenser and first expansion valve; a second evaporator wound like a coil for flowing a second refrigerant passed through a second compressor, second condenser and second expansion valve, wherein the second condenser disposed through the first evaporator; a cleaning medium conduit consisting of an inlet and outlet and intermediate portion wound like a coil along the second evaporator for flowing a cleaning medium; a temperature sensor arranged in the outlet of the cleaning medium conduit for measuring the temperature of the cleaning medium discharged; and a heater controlled according to the temperature measured by the temperature sensor.

According to still another aspect of the present invention, an aerosol generation system comprises a cleaning medium source for supplying a cleaning medium, carrier gas source for supplying a carrier gas, a cooling device for refrigerating the cleaning medium supplied from the cleaning medium source, and a nozzle for ejecting a mixture of the cleaning medium and the carrier gas, respectively, supplied from the cooling device and the carrier gas source.

According to an embodiment of the present invention, the cleaning medium is a carbon dioxide.

According to an embodiment of the present invention, the cleaning medium is refrigerated in the intermediate portion of the cleaning medium conduit thereby being transformed into a liquid phase.

According to an embodiment of the present invention, the heater is so arranged as to contact the evaporator or the intermediate portion of the cleaning medium conduit.

According to an embodiment of the present invention, the phase-transition rate of the cleaning medium is adjusted by the heater.

According to an embodiment of the present invention, the intermediate portion of the cleaning medium conduit is disposed inside the evaporator with extending of the same configuration as the evaporator.

According to an embodiment of the present invention, the intermediate portion of the cleaning medium conduit is arranged to surround the evaporator with extending of the same configuration as the evaporator.

According to an embodiment of the present invention, the cleaning medium is refrigerated to a temperature in the range of −80° C. to −100° C. in the intermediate portion of the cleaning medium conduit.

According to an embodiment of the present invention, the refrigeration rate of the second refrigerant is higher than that of the first refrigerant.

PREFERRED EMBODIMENTS OF THE INVENTION

Figure 1:
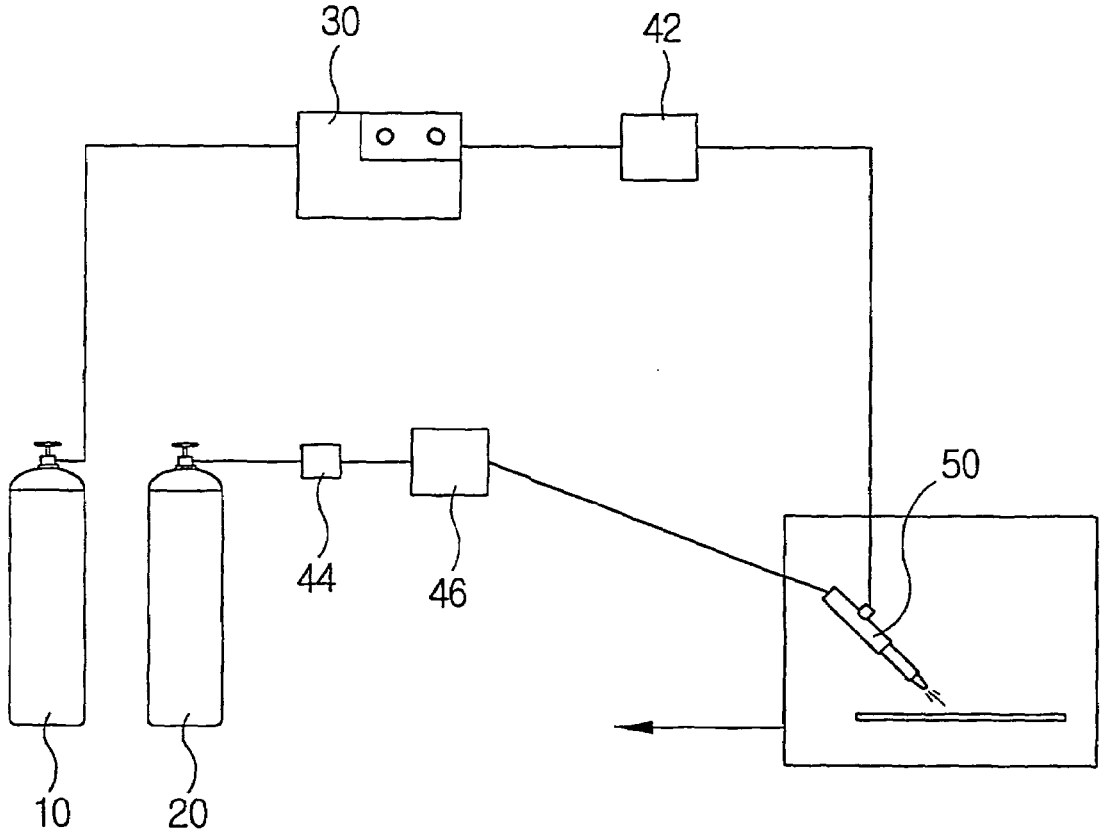
FIG. 1 is a block diagram for illustrating an aerosol generation system according to the present invention.

FIG. 1 illustrates the structure of an aerosol generation system according to an embodiment of the present invention, which comprises a cleaning medium source 10, carrier gas source 20, nozzle 50, and cooling device 30.

The cleaning medium source 10 stores a cleaning medium. For the cleaning medium is preferably used carbon dioxide ($CO_2$) or argon (Ar) of high purity. To be brief description, the present invention is described herebelow with a reference to carbon dioxide. The carbon dioxide is supplied from the cleaning medium source 10 through a first conduit 14 to the cooling device 30.

Figure 2:
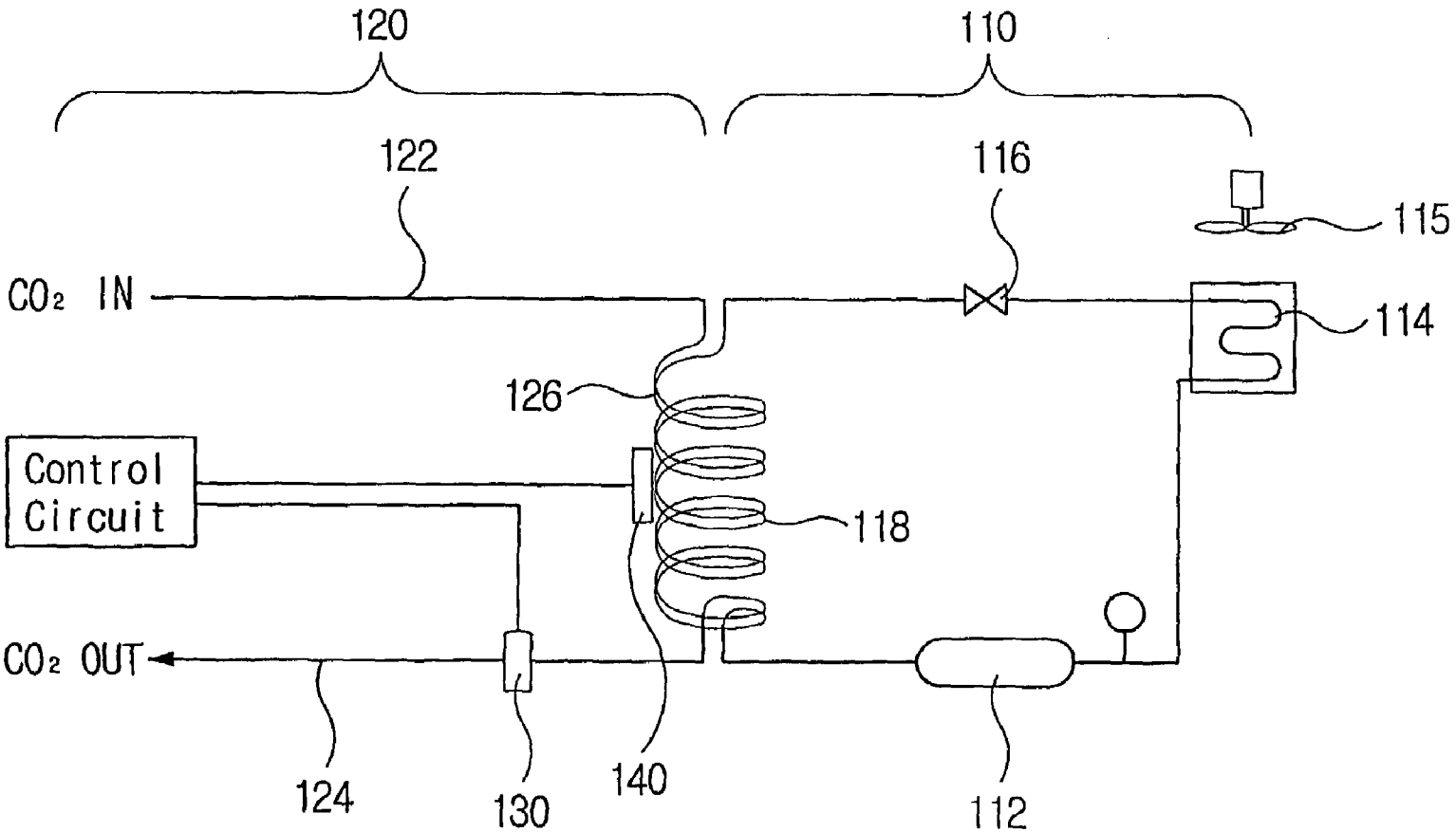
FIG. 2 is a diagram for illustrating a cooling device according to an embodiment of the present invention.

Referring to FIG. 2, the cooling device 30 comprises a refrigerator 110 of the reverse Carnot cycle-type which is connected to a compressor 112, condenser 114, expansion valve 116 and evaporator 118 by a refrigerant conduit for circulating a refrigerant, a cleaning medium conduit 120 having an inlet 122 and outlet 124 and intermediate portion 126 passing through the evaporator 118 for flowing the carbon dioxide, a temperature sensor 130 and a heater 140.

Working the refrigerator 110, the refrigerant is supplied as dry saturated vapor to the compressor 112 to generate adiabatically compressed overheated vapor and is then condensed through the condenser 114 to turn into a saturated condensate. The condensation of the refrigerant is performed by means of atmosphere enhanced by an adjacent fan 115. Thereafter, the saturated condensate is adiabatically expanded by passing through the expansion valve 116 to produce a wet saturated vapor and in turn passed through the evaporator 118 to be evaporated by absorbing the heat of the carbon dioxide flowing through the intermediate portion 126 of the cleaning medium conduit 120.

Figure 4A:
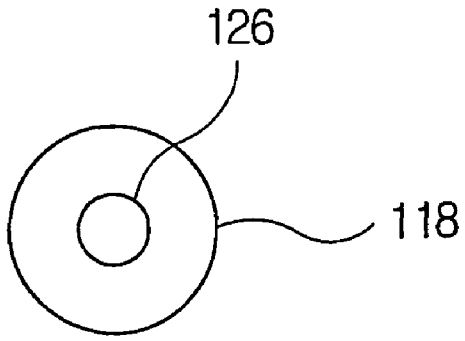
FIGS. 4A to 4C are cross sectional views for illustrating an evaporator shaped like a coil and the intermediate portion of a cleaning medium conduit in a cooling device according to various embodiments of the present invention.
Figure 4B:
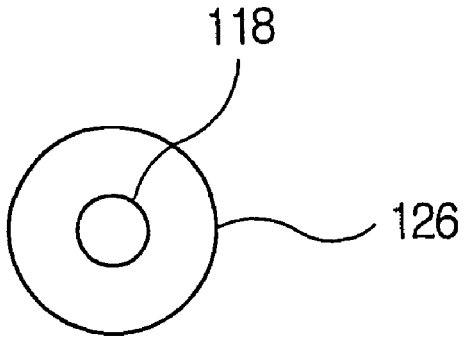
Figure 4C:
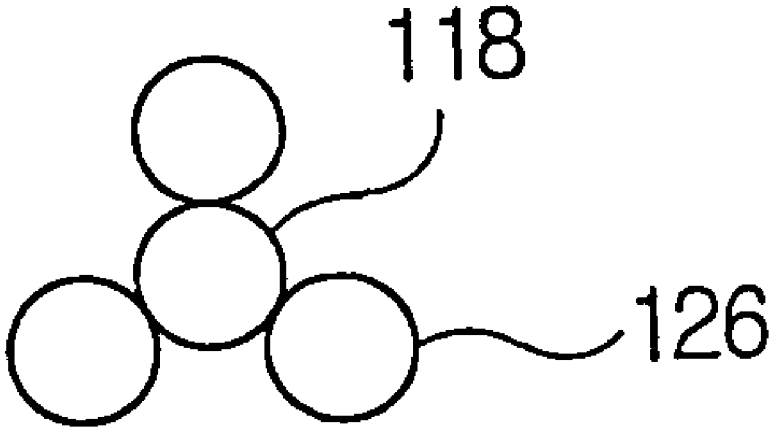

Thus, the gaseous carbon dioxide coming into the inlet 122 of the cleaning medium conduit 120 is refrigerated through the intermediate portion 126, partially transformed into liquid phase. The rate of the carbon dioxide being transformed into liquid phase is expedited by extending the intermediate portion 126 of the cleaning medium conduit 120 along the coil-shaped evaporator 118 in the same configuration to maximize the contacting time between them. There are various ways to contact the intermediate portion 126 of the cleaning medium conduit 120 to the evaporator 116 with considering the contacting area. FIGS. 4A to 4C are cross sectional views for illustrating the ways of contacting the intermediate portion 126 of the cleaning medium conduit 120 and the evaporator 118 according to various embodiments of the present invention. Referring to FIG. 4A, the intermediate portion 126 of the cleaning medium conduit 120 may be a single tube arranged to be surrounded by the evaporator 118. On the contrary, the intermediate portion 126 of the cleaning medium conduit 120 may be a single tube arranged to surround the outside of the evaporator 118. Alternatively, the intermediate portion 126 of the cleaning medium conduit 120 may be a plurality of tubes arranged to contact the outside of the evaporator 118. Preferably, the evaporator 118 of the refrigerator 110 and the intermediate portion 126 of the cleaning medium conduit 120 are insulated from the outside by means of an insulation material such as polyurethane.

Referring to FIG. 2, the carbon dioxide passing through the intermediate portion 126 of the cleaning medium conduit 120 is discharged through the outlet 124 to the outside of the cooling device 30. According to the present invention, the temperature of the carbon dioxide discharged through the outlet 124 of the cleaning medium conduit 120 to the outside of the cooling device 30 is controlled at a temperature in the range of −80° C. to −100° C.

The temperature sensor 130 is arranged in the outlet 124 of the cleaning medium conduit 120 to sense the temperature of the discharged carbon dioxide. The heater 140 is arranged in the outside of the intermediate portion 126 of the cleaning medium conduit 120 and the evaporator 118 to precisely control the liquefying rate of the carbon dioxide. The temperature of the carbon dioxide detected by the temperature sensor 130 is applied to a control circuit to control the operation of the heater 140, so that the ratio between the gas and liquid in the cleaning medium refrigerated near the liquefying point, namely, the liquefying rate of the carbon dioxide, may be adjusted, thus more precisely controlling both the amount and the particle size of an aerosol generated from the nozzle.

Figure 3:
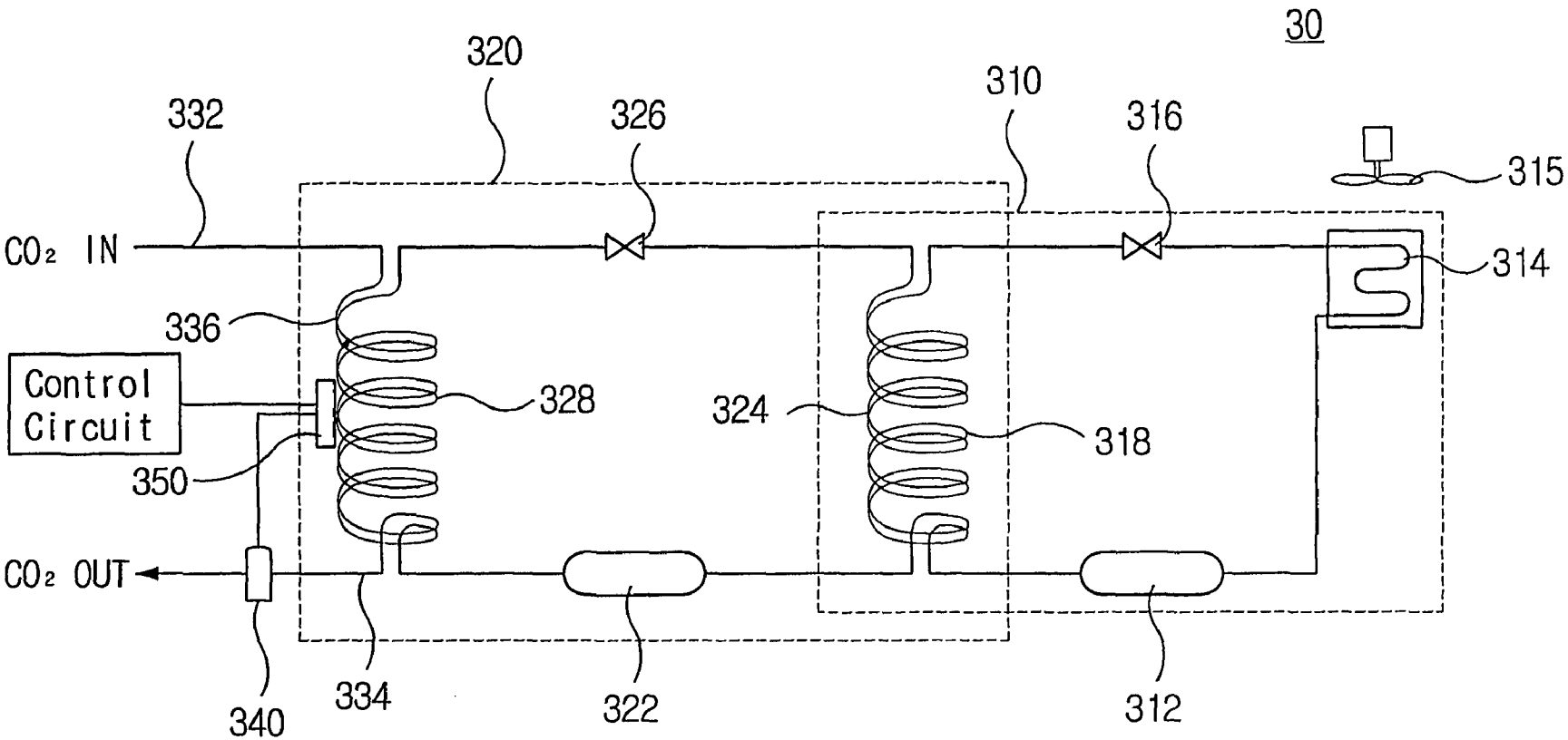
FIG. 3 is a diagram for illustrating a cooling device according to another embodiment of the present invention.

Referring to FIG. 3 for illustrating the cooling device 30 according to a second embodiment of the present invention, two-stage cooling system is employed including a first refrigerator 310 and second refrigerator 320, compared with the first embodiment. The first and second refrigerators 310 and 320 are of reverse Carnot cycle-type, respectively comprising compressors 312 and 322, condensers 314 and 324, expansion valves 316 and 326, and evaporators 318 and 328. The first refrigerator 310 uses a first refrigerant R404 while the second refrigerator 320 uses a second refrigerant R32 with a refrigeration rate higher than the first refrigerant R404. In the first refrigerator 310, the condensation of the first refrigerant is achieved by the atmosphere, expedited by a fan 315 adjacent to the condenser 314. The first evaporator 318 of the first refrigerator 310 is wound like a coil. The second condenser 324 of the second refrigerator 320 is so arranged as to pass through the first evaporator 318 of the first refrigerator 310. Thus, the second refrigerant circulating through the second refrigerator 320 is condensed by exchanging heat with the first refrigerant circulating in the first refrigerator 310. The first refrigerant passing through the first expansion valve 316 is refrigerated at a temperature in the range of −40° C. to −50° C. Hence, the second refrigerant of the second refrigerator 320 passing through the first evaporator 318 of the first refrigerator 310 is refrigerated at a temperature in the range of −40° C. to −50° C., which in turn passes through the second expansion valve

326 finally refrigerated at a temperature in the range of −80° C. to −100° C. The carbon dioxide is refrigerated at a temperature in the range of −80° C. to −100° C. by exchanging heat with the second refrigerant in the second evaporator 328 of the second refrigerator 320. The other parts of the structure and operation of the cooling device 30 according to the second embodiment are similar to those of the first embodiment.

Referring to FIG. 1, the carbon dioxide passing through the cooling device 30 is supplied through a flow regulator 42 to the nozzle 50. The flow regulator 42 regulates the amount of the carbon dioxide supplied to the nozzle 50.

The carrier gas source 20 stores a carrier gas for carrying the cleaning medium at high speed. The carrier gas is supplied from the carrier gas source 20 through a pressure regulator 44 and flow regulator 46 to the nozzle 50. The carrier gas may be selected among air, nitrogen ($N_2$), and argon (Ar), and preferably nitrogen ($N_2$). The pressure of the nitrogen supplied to the nozzle 50 is regulated at an optimum value in the range of 40 Psi to 160 Psi, that may solidify the carbon dioxide.

The supplied carbon dioxide and nitrogen are mixed ejected through the nozzle 50 of venturi-type. The carbon dioxide passing through the nozzle 50 of venturi-type is refrigerated due to Joule-Thomson effect, transformed into fine particles of solid phase, which constitute an aerosol ejected at high pressure to clean the microelectronic surfaces.

While the present invention has been described in connection with specific embodiments accompanied by the attached drawings, it will be readily apparent to those skilled in the art that various changes and modifications may be made thereto without departing the gist of the present invention. Therefore, the full scope of the present invention should be ascertained from the claims that follow.

What is claimed is:

1. A cooling device comprising;

an evaporator wound like a coil for flowing a refrigerant made to have low temperature and low pressure through a compressor, condenser, and expansion valve;

a cleaning medium conduit consisting of an inlet and outlet and intermediate portion wound like a coil along said evaporator for flowing a cleaning medium;

a temperature sensor arranged in the outlet of said cleaning medium conduit for measuring the temperature of the cleaning medium discharged; and a heater controlled according to the temperature measured by said temperature sensor.

2. A cooling device as defined claim 1, wherein said cleaning medium is carbon dioxide.

3. A cooling device as defined claim 1, wherein said cleaning medium is refrigerated in the intermediate portion of said cleaning medium conduit transformed into liquid phase.

4. A cooling device as defined claim 1, wherein the intermediate portion of said cleaning medium conduit is formed of a single tube disposed inside the evaporator in the same configuration as the evaporator.

5. A cooling device as defined claim 1, wherein the intermediate portion of said cleaning medium conduit is formed of a single tube surrounding the evaporator in the same configuration as the evaporator.

6. A cooling device as defined claim 1, wherein the intermediate portion of said cleaning medium conduit is formed of a plurality of tubes so arranged as to contact and extend along the outside of the evaporator in the same configuration as the evaporator.

7. A cooling device as defined claim 1, wherein said cleaning medium is refrigerated at a temperature in the range of −80° C. to −100° C. by heat-exchanging with the evaporator in the intermediate portion of said cleaning medium conduit.

8. An aerosol generation system including the cooling device as defined in claim 1, further includes a cleaning medium source for supplying the cleaning medium to said cooling device, a carrier gas source for supplying a carrier gas, and a nozzle for ejecting a mixture of the cleaning medium and the carrier gas respectively supplied from said cooling device and carrier gas source.

* * * * *